US012071866B1

(12) United States Patent
Levin

(10) Patent No.: US 12,071,866 B1
(45) Date of Patent: Aug. 27, 2024

(54) COUPLED ORC HEAT PUMP ELECTRIC GENERATOR SYSTEM

(71) Applicant: Joel M. Levin, Wynnewood, PA (US)

(72) Inventor: Joel M. Levin, Wynnewood, PA (US)

( * ) Notice: Subject to any disclaimer, the term of this patent is extended or adjusted under 35 U.S.C. 154(b) by 0 days.

(21) Appl. No.: 18/500,413

(22) Filed: Nov. 2, 2023

(51) Int. Cl.

| | |
|---|---|
| ***F01K 23/04*** | (2006.01) |
| ***F01K 3/18*** | (2006.01) |
| ***F01K 13/02*** | (2006.01) |
| ***F01K 15/04*** | (2006.01) |
| ***F01K 25/10*** | (2006.01) |
| ***F25B 11/02*** | (2006.01) |
| ***F25B 29/00*** | (2006.01) |

(52) U.S. Cl.
CPC ..... *F01K 23/04* (2013.01); *F01K 3/185* (2013.01); *F01K 25/10* (2013.01); *F25B 11/02* (2013.01); *F25B 29/003* (2013.01); *F01K 13/02* (2013.01); *F01K 15/04* (2013.01)

(58) Field of Classification Search
CPC ..... F01K 25/08; F01K 25/10; F01K 23/04; F01K 17/005
USPC ..... 60/655
See application file for complete search history.

(56) References Cited

U.S. PATENT DOCUMENTS

| | | | | |
|---|---|---|---|---|
| 4,700,543 | A * | 10/1987 | Krieger | F01K 3/185 60/698 |
| 9,163,868 | B2 | 10/2015 | Ducheyne et al. | |
| 9,746,191 | B2 | 8/2017 | Kang et al. | |
| 9,797,603 | B2 | 10/2017 | Bannister et al. | |
| 9,989,278 | B1 | 6/2018 | Kreuger | |
| 10,168,072 | B2 | 1/2019 | Lucas et al. | |
| 10,302,335 | B2 | 5/2019 | Kim et al. | |
| 10,835,836 | B2 | 11/2020 | Goldshtein et al. | |
| 10,968,883 | B2 | 4/2021 | Maynard | |
| 11,156,385 | B2 | 10/2021 | Laughlin et al. | |
| 11,489,176 | B2 | 11/2022 | Tauveron et al. | |
| 11,644,014 | B2 | 5/2023 | Bodishbaugh et al. | |
| 2011/0309635 | A1 * | 12/2011 | Sardo | F01K 17/005 290/1 A |
| 2012/0125019 | A1 | 5/2012 | Sami | |
| 2013/0205778 | A1 | 8/2013 | Hansen | |
| 2014/0053557 | A1 | 2/2014 | Almogy et al. | |
| 2016/0156309 | A1 | 6/2016 | Almogy et al. | |

(Continued)

FOREIGN PATENT DOCUMENTS

| | | | | |
|---|---|---|---|---|
| DE | 102020006763 | A1 | 4/2022 | |
| WO | WO-2015041501 | A1 * | 3/2015 | F01K 25/08 |
| WO | WO-2015050372 | A1 * | 4/2015 | F01K 25/00 |

*Primary Examiner* — Laert Dounis

(57) ABSTRACT

A power generation system includes an Organic Rankine Cycle (ORC) electric generator thermally coupled to a stack of industrial heat pumps (IHPs). The ORC requires heat to generate electricity. The IHPs require electricity to generate heat. The IHPs have an efficiency much greater than 100% because some of the output heat from an IHP is pre-existing heat extracted from available source water, The temperature of the source water can be as low as 70° F. By configuring the IHPs to maximize their efficiency, the electricity required to operate the IHPs can be reduced below the output electricity from the ORC. The surplus electricity produced by the ORC is available for export. This coupled ORC/Heat Pump system is an electric generator that requires no fuel to operate and produces no emissions. The required energy is provided by the heat extracted from the source water by the IHPs.

20 Claims, 3 Drawing Sheets

(56) References Cited

U.S. PATENT DOCUMENTS

| | | | | |
|---|---|---|---|---|
| 2017/0241679 | A1 | 8/2017 | Yanagi | |
| 2023/0251031 | A1 * | 8/2023 | Tanaka | F25J 1/005 62/48.2 |

* cited by examiner

COUPLED ORC HEAT PUMP ELECTRIC GENERATOR SYSTEM

BACKGROUND OF THE INVENTION

The present invention relates to energy production without the need for fuel and without the production of the associated carbon emissions and, more particularly, to electrical energy production.

Most electricity is generated by steam turbines powered by fossil fuel. Burning fossil fuels causes copious emission of carbon and other air polluting byproducts. The carbon emissions from power plants are one of the major contributors to global warming. The cost of purchasing the required fuel is usually the largest cost item in power plant budgets.

Centralized power plants require expensive and extensive electric distribution systems. Delivery of electricity from central power plants can be disrupted by weather events, cyber-attacks, or physical sabotage.

Large power plants require extensive ancillary infrastructure to function. This creates impediments to siting because of the environmental impact, the delays in obtaining permits, and the cost of creating the necessary infrastructure. Electrification of remote areas and undeveloped countries is limited by the lack of necessary infrastructure.

All nuclear power generation plants produce radioactive waste that requires permanent monitored storage, generally in pools.

All these existing electrical power generation plants depend on access to a reliable source of fossil fuel or nuclear fuel to operate, whether from within their own countries or from abroad. Sometimes supply chains are interrupted, preventing the plants from operating. Frequently political stability and integrity are disrupted by the exigencies of obtaining fossil fuel.

As can be seen, there is a need for improved electrical power generation plants that do not require fuel and do not produce emissions.

Power plants using the well-known Organic Rankine Cycle do not burn fuel and do not produce emissions because they use existing streams of waste heat at temperatures of about 200° F. or greater to provide their thermal energy requirements. However, the number of sites in the world where such streams of waste heat are available is very limited. The system disclosed herein will vastly increase the number of sites where Organic Rankine Cycle power plants can be installed to produce electricity without burning fuel and without producing the associated emissions.

SUMMARY OF THE INVENTION

In one aspect of the present invention, a power generation system comprises a stack of multiple industrial heat pumps (IHPs) having a high collective coefficient of performance, wherein each IHP is operative to vaporize a first refrigerant (each IHP having a first refrigerant which may be the same or different than the first refrigerant in another of the IHPs) in a liquid phase by transferring heat from an available stream of source water in a first evaporator (each IHP having a first evaporator) configured to receive and vaporize the first refrigerant to a vapor phase. The vaporized first refrigerant in each IHP is compressed by a compressor which raises the temperature and pressure of the vaporized first refrigerant to a second temperature and a second pressure, wherein the second temperature of the vaporized first refrigerant is higher than the first temperature of the vaporized first refrigerant and the second pressure of the vaporized first refrigerant is higher than the first pressure of the vaporized first refrigerant. In each IHP the hot, pressurized first refrigerant vapor is passed through an IHP condenser where it transfers its heat to a stream of liquid heat transfer fluid (the sink), raising the temperature of the sink heat transfer fluid which then leaves the IHP to provide heat to a selected external thermal load; and an organic Rankine cycle generator (ORC) having a pump, an evaporator, a turboexpander, an ORC condenser, and a condensate receiving tank; wherein the hot sink heat transfer fluid generated by the IHPs passes through one chamber of the ORC evaporator and vaporizes a second pressurized liquid refrigerant (which may be the same as or different from the first refrigerant) in the second chamber of the ORC evaporator; the vaporized second refrigerant then drives a turboexpander in the ORC that is operative to generate an amount of electricity from the second vaporized refrigerant; and wherein the amount of electrical energy generated is greater than the amount of electricity required to operate all of the IHPs in the stack.

The efficiency of an IHP is characterized by its coefficient of performance (COP) which is defined as the ratio of output thermal power to input electrical power. The COP of an IHP can be much greater than one, and the COP of an IHP can be increased by careful configuration. If the collective COP of all the IHPs is sufficiently high, the electric power required by the IHPs is less than the electric power generated by the ORC, and the surplus electric power can be exported to the grid. The combined ORC/Heat Pump system provides electric power generation that requires no fuel and produces no carbon emissions or radioactive residues. The surplus electricity remaining after the power requirements of the IHPs are met becomes exportable electricity to a power grid. The only impact on the external environment is to reduce the temperature of the source water stream that provides the heat required to vaporize the first refrigerant in the evaporator of each of the industrial IHPs.

ORC/Heat PUMP power plants according to the present subject matter may be built anywhere in the world where the necessary source water is available and a source of cooler condenser water is also available. Source water temperatures as low as 70° F. may be used if sufficiently cool condenser water is available. Facilities may be built in stand-alone locations to serve local needs. The electrical power generation system according to aspects of the present invention does not require national and international supply chains for fuel because thermal energy for operation of the electrical power generation is extracted from local wastewater flows and/or bodies of water. In some embodiments, leaving condenser water from chillers or existing power plants or river water may be used as source water, enabling distributed energy generation in remote areas or in underdeveloped areas of the world that presently do not have electric distribution networks or extensive infrastructure to deliver fuel.

In some embodiments, electric power may be generated on board maritime vessels, using surface water as source water while drawing cooler condenser water from lower depths. The discharged source water is generally cooler than the incoming source water, which helps to reduce ocean warming. The generated power may eliminate or reduce the use of fossil fuels for propulsion.

In desert areas, source water may be provided by a pumped closed loop using passive solar tanks to replace the extracted heat. Cooling water can be drawn from aquifers and then distributed for other uses since passing through a condenser/heat exchanger will not pollute the water.

If widely utilized, the system disclosed herein may have a major impact on reducing demand for fossil fuel and reducing air pollution and global warming.

These and other features, aspects and advantages of the present invention will become better understood with reference to the following drawings, description, and claims.

DETAILED DESCRIPTION OF THE INVENTION

Figure 1:
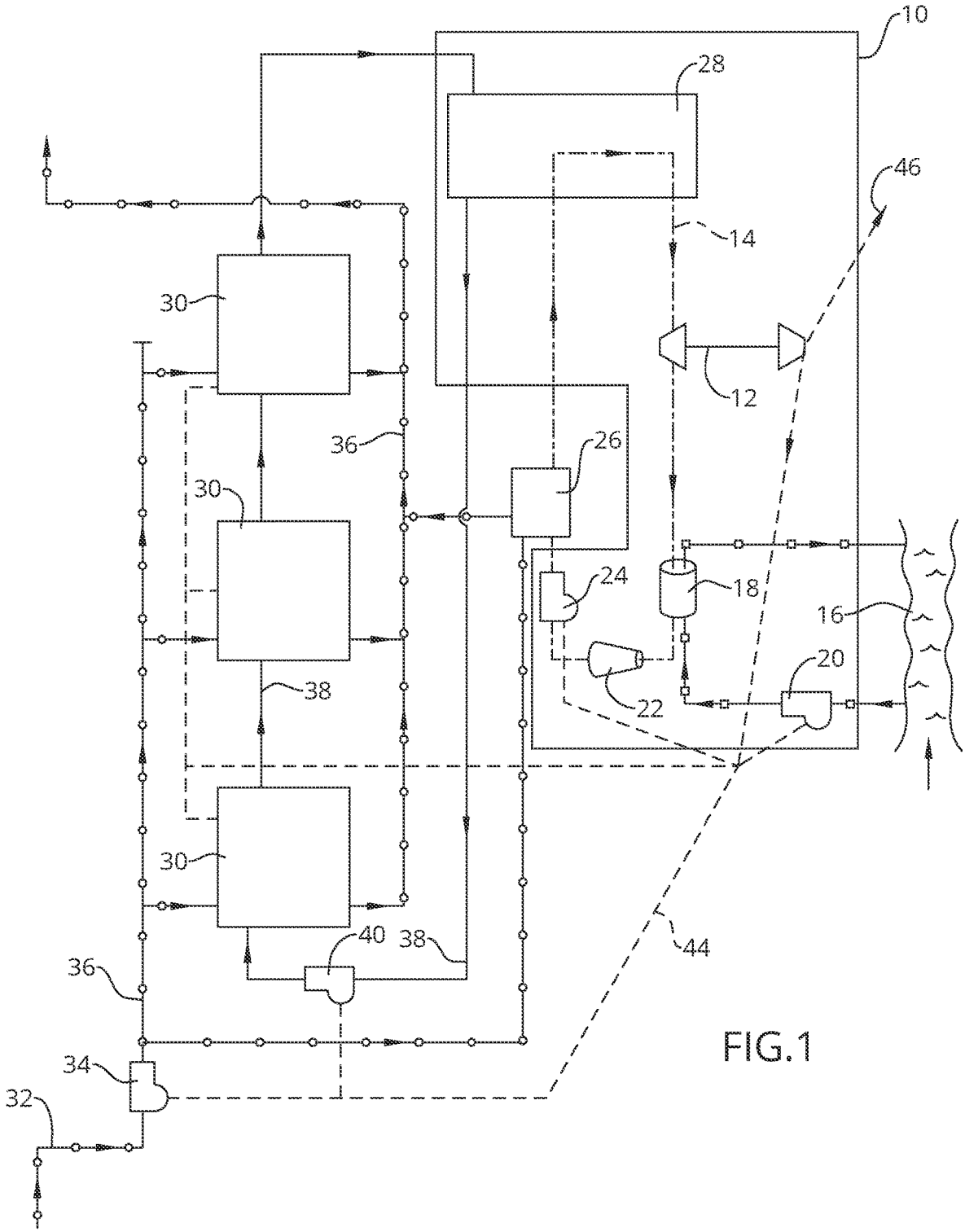
FIG. 1 is a schematic view of a system according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a system, method, and apparatus for power generation comprising organic Rankine cycle (ORC) generators and a stack of series connected IHPs, staged to provide successively higher sink heat transfer fluid output temperatures from each IHP.

As used herein, the term "hot water" refers to a sink heat transfer fluid such as heating hot water that has been generated by an IHP and exported from the IHP to provide heat to an external load.

As used herein, the term "warm water" or "source water" refers to an available stream of waste water, river water, geothermal water, or leaving condenser water that can be used as source water for each of the IHPs.

As used herein, the term "cold water" refers to water having a temperature at least 14° C. (25° F.) below the temperature of the source water. Cold water is generally required as condenser water for the ORC refrigerant leaving the turboexpander of the ORC.

The term "lift" refers to the difference between the temperature of the hot vaporized working fluid leaving the IHP compressor and the temperature of the source water leaving the IHP evaporator after its temperature has been reduced because some of its heat has been extracted to vaporize the IHP refrigerant in the IHP evaporator.

Several of the components of the system described herein are identified as, or serve as, a heat exchanger. The type of heat exchanger selected is not particularly limited and may be any suitable heat exchanger known in the art for use with the fluids disclosed herein at the conditions to which they are exposed.

ORCs are electric generators that use refrigerants with low boiling points as working fluids and use low temperature waste heat streams as a heat source. An ORC system generally comprises a pump, an evaporator, a turboexpander and a condenser. The pressurized liquid ORC refrigerant in the ORC evaporator is vaporized by the stream of incoming heat from the external heat source. The vaporized refrigerant then drives a turboexpander in the ORC that generates electricity. The spent ORC refrigerant vapor is condensed to a liquid state in a condenser, and the condensed liquid refrigerant is then pumped back up to its original pressure in the ORC evaporator.

An IHP is a water-source heat pump that produces a given quantity of output heat for much less input energy than a boiler would require by transferring heat from a stream of warmer source water to a refrigerant by vaporizing the refrigerant (sometimes referred to herein as the first refrigerant or the IHP refrigerant to differentiate from a refrigerant used elsewhere in the system). In the context of the present disclosure, the vaporized refrigerant is then compressed and the heat originally transferred to the vaporized refrigerant is in turn transferred through a condenser from the compressed vaporized refrigerant to a heat transfer fluid for export from the IHP. The condensed refrigerant is then passed through an expansion valve and returned to the evaporator. Generally, an IHP comprises a compressor, a condenser, an expansion valve, and an evaporator.

The efficiency of an IHP is usually characterized by a coefficient of performance (COP) which is defined as the ratio of the output heat energy produced to the input electric energy required to operate the IHP. The COP of an IHP is not immutable and it can be increased by careful configuration. For example, if an IHP raises the temperature of one pound of water per hour from 80° F. to 180° F. with a source water flow of one pound per hour, the COP will be 2.3 and the input energy required by the IHP will be 44 British Thermal Units (BTU) per hour. However, if the single IHP is replaced by two IHPs, each IHP drawing source water from the same source, the first one raising the sink temperature by 50° F., and the second one raising the temperature of the warm sink water leaving the first IHP by an additional 50° F., the amount of heat extracted from the source water will increase, the lift of the first IHP will decrease, and the net COP of the two IHPs will be increased from 2.3 to 5.0. The input energy required to produce the same heating output will be reduced from 44 BTUs per hour to 20 BTUs per hour.

For a single IHP, the COP depends on the temperature of the source water, the mass flow rate of the source water, the lift of the IHP, the thermal load of the IHP, and the output temperature of the IHP. If multiple IHPs are utilized, the net COP of the total stack of IHPs (total thermal energy produced divided by total electric input energy required) also depends on the configuration of the IHPs, the connection pattern of the IHPs to one another, the connection pattern of the IHPs to the source water, and to the allocation of the partial loads to the various IHPs. The COP of a single IHP will normally be in the range of 1 to 10. For very low lifts it can be even higher.

The high efficiency of an IHP is achieved by using the suction side of a compressor to lower the pressure in the refrigerant chamber of an IHP evaporator, thereby lowering the boiling point of the liquid refrigerant below the temperature of the source water, then boiling the refrigerant with heat absorbed passively from the source water passing through the second chamber of the IHP evaporator. The heat absorbed from the source water by the refrigerant is stored as latent heat in the vaporized refrigerant. A compressor then raises the pressure and temperature of the refrigerant vapor to reach a selected target temperature and pressure. The operation of the compressor motor generates additional heat which is added to the extracted heat that is already stored in the hot vaporized refrigerant. The total heat output of the IHP is the sum of the extracted heat stored in the vaporized refrigerant plus the additional heat created by the operation of the compressor motor.

The hot pressurized refrigerant vapor leaving the compressor flows to one chamber of the IHP condenser where it transfers its latent heat to a stream of heating hot water or a sink heat transfer fluid passing through the second chamber of the condenser. The IHP refrigerant is condensed and then passes through an expansion valve and returns to the inlet port of the IHP evaporator.

Since the amount of electricity available for export from the plant is the difference between the amount of electricity produced by the ORC and the amount of electricity consumed by the IHPs, reducing the electric input requirements of the IHPs is an essential element of designing a successful ORC/Heat Pump system, and this requires configuring the IHPs to achieve a high COP.

The COP of an IHP increases as the lift decreases. Therefore, in order to reduce the overall IHP COP, instead of using a single IHP with a large lift and a small COP to reach a selected target temperature for the heat transfer fluid leaving the IHP, multiple smaller IHPs, most with a smaller lift, must be connected in series to increase the collective COP of the overall system. Each IHP raises the temperature of the heat transfer fluid leaving the previous IHP by a small percentage of the total design temperature rise, and each of the IHPs must draw its source water from a common source or manifold. For the IHPs with the lower leaving temperatures, the lift is small so the COPS are high. Consequently, they should be designed to generate a disproportionately large fraction of the total temperature rise. Conversely, for the IHPs with the highest leaving temperatures, their lifts are large, their COPs are small, and consequently they should be designed to generate a disproportionately small fraction of the total temperature rise.

The sink heat transfer fluid is selected from pressurized water or an appropriate thermal fluid. In order to produce the benefits of increasing the net COP by staging the output temperatures from each IHP, the boiling point of the selected sink heat transfer fluid must be greater than the highest outlet temperature of any IHP in the entire IHP stack.

The thermal output of the IHP stack is a flow of heat transfer fluid at a predetermined outlet temperature that provides the heat required to vaporize the pressurized ORC refrigerant in the ORC evaporator.

Some of the electricity generated by the ORC is directed to the IHPs to run the compressors. However, because of the high COP of the IHPs, the ORC generates more electricity than the IHPs require. The rest of the electricity produced may be transmitted to the grid through an electric interface. Alternatively, the excess electricity may be used elsewhere onsite or stored, e.g., in a battery.

In a non-limiting example, an ORC with a conversion efficiency of 20% would require 500 KW of thermal energy to yield 100 kW of output electricity. If a boiler with a nominal efficiency of 80% were used to generate the required 500 kW of heat, an input of 625 KW of fossil fuel energy would be required (500/80%=625). Thus, the conversion efficiency from fossil fuel to electricity would be only 16% (100/625=0.16). In contrast, if the 500 KW of heat required by the ORC were provided by an IHP with a COP of 10, the input electricity required by the IHP would be only 50 KW (500/10=50). After providing the required 50 KW to the IHPs, there would be a surplus of 50 KW from the 100 KW produced by the ORC which would then be available for export.

The 500 KW of thermal input energy heat required by the ORC would be composed of 50 KW from the operation of the compressor motor plus 450 KW of heat energy extracted from the source water by the IHPs. To achieve this result, the COP of the IHP(s) must be very high, reducing their draw of electricity.

The selection of an ORC refrigerant is also governed by the objective of reducing the input energy required by the IHPs. Therefore, it is preferable to select a refrigerant with a low boiling point and a low heat of vaporization at that point in order to reduce both the lift and the thermal load of the IHPs. Preferably, the difference between the saturated vapor temperature of the selected ORC refrigerant and the temperature of the available source water stream is minimized in order to minimize the required lift and maximize the COP of the IHPs. The ORC refrigerant may also be selected for low global warming potential (GWP) and low oxygen depletion potential (ODP). The enthalpy of the vaporized ORC refrigerant at its saturated vapor point may be determined from a pressure-enthalpy table for the selected refrigerant. The difference between the enthalpy of the refrigerant at this saturation point and the enthalpy of the condensed liquid ORC refrigerant determines the heating load per pound of ORC refrigerant required to vaporize the ORC refrigerant. Since the temperature of the ORC condensate is less than the temperature of the available IHP source water, part of the ORC refrigerant heating load can be supplied by passing the cold ORC refrigerant condensate through a preheater heat exchanger that uses a side (i.e., diverted) stream of the available source water to passively raise the temperature of the cold ORC refrigerant condensate. Preheating the ORC refrigerant condensate with source water reduces the ORC refrigerant heating load that must be supplied by the IHP stack, reduces the input power used by the IHPs, and therefore increases the amount of electricity available for export. Therefore, it is desirable to enhance or maximize the amount of heat transferred by the preheater heat exchanger.

The power generation system disclosed herein may be installed at any site with access to a large body of water, access to a cooler source of water to serve as condenser water, and to local electric loads or to an electrical power distribution grid to export electricity to end users without fuel costs or emissions. Most variable costs of producing electricity are substantially reduced. Electrical power generation plants according to an embodiment of the present invention do not require ancillary infrastructure to function. Consequently, there are very few impediments to bringing electrification to remote and underserved locations. The coupled ORC and IHPs can then produce electricity for local or remote consumption.

The source water may be supplied by any body of water that can provide a continuous flow of source water for the multi-stage IHPs such as, but not limited to, a river, an ocean, a stream, a sewer line, or a line of warm condenser water leaving an adjacent power plant, chiller, or factory. The cooled source water leaving the IHP evaporator may be returned to the original body of source water at a point downstream from the intake point.

The amount of heat extracted from the source water is the product of the source water flow rate times the temperature drop of the source water. As the temperature drop increases, the leaving temperature of the source water decreases, thereby increasing the lift and lowering the COP of the IHP. Consequently, a large source water flow rate should be selected in order to minimize the temperature drop of the source water as it passes through the evaporator. The temperature of the source water leaving the evaporator of each IHP can be designed to be only one or two OF below the incoming source water temperature. This slightly cooled source water can then be used again as source water for a subsequent IHP/ORC round to generate additional exportable electricity. If the selected source water being used for the IHPs is the leaving condenser water from an adjacent facility or process that requires cooling before being returned, this process may be repeated until the temperature of the source water is reduced to the target temperature of the existing cooling tower. Thus, the expense and plume of a cooling tower may be eliminated while generating electricity without consuming fuel at a very low variable cost. For example, condenser water exiting a steam turbine of a power plant may be used as source water for a system disclosed herein. The IHP/ORC system may generate enough additional electricity to increase the plant power output by 10%-20% without using additional fuel and without increasing emissions. Since the IHP/ORC system is a closed loop system, it is not dependent on the ambient wet bulb conditions. Therefore, this approach will have the additional benefit of returning cooled condenser water to the facility at the design temperature regardless of the ambient wet bulb conditions.

A source of cold water at a temperature at least 25° F. below the temperature of the available supply of source water must also be available to condense the ORC refrigerant leaving the turboexpander.

The input energy required to raise a specified quantity of water through a specified temperature rise using a single IHP is significantly higher than the cumulative energy required by a series of small IHPs, each drawing source water from the same reservoir, each contributing part of the required temperature rise with a small lift. Using a stack of multiple small IHPs increases the amount of heat extracted from the source water, thereby reducing the amount of heat that must be added by the compressor and reducing the input electricity required by the IHPs. Therefore, in order to substantially maximize the amount of exportable electricity from the system, multiple IHPs in series, each raising the temperature of a heat transfer fluid by a specified fraction of the total load, are employed in a system described herein.

Circulation pumps deliver source water from a reservoir or a source water manifold that serves each of the IHPs in the stack and circulates the source water through the IHP evaporators. The incoming source water may be fed in parallel to each IHP in a stack of n IHPs, with control valves to deliver the flow of incoming source water that is appropriate for the heating load of each of the n IHPs. The amount of source water flow through each IHP is selected to minimize the temperature drop of the source water in order to minimize the lift and thereby maximize its COP. The flow rate of source water to each of the IHPs may be distinct from the flow rates to the rest of the IHPs in the stack. The objective is to select source water flows that minimize the temperature drop of the source water in each IHP to minimize the lift and maximize the COP of each IHP in order to maximize the collective COP of the stack and thereby minimize the input power required by the IHPs. The collective COP of the stack is defined as the total output thermal energy produced by all of the IHPs in the stack divided by the total input electric energy required by all of the IHPs in the stack.

An ORC must be selected to have a rated electric output capacity that can supply all the electricity required by the IHPs while also producing a predetermined surplus amount for export from the plant. In some embodiments, the system may comprise multiple ORCs, each ORC coupled to one of multiple IHP stacks.

In some embodiments, the Joule-Thompson expansion valve in each IHP may be replaced with a Flashing Liquid Expander (FLE). The FLE contains a turboexpander that is driven by the pressure difference between the condensed high pressure IHP refrigerant leaving the IHP condenser and the low pressure of the refrigerant in the IHP evaporator. The turboexpander uses this pressure difference to generate additional electricity, thereby reducing the amount of electricity that the IHP requires from the ORC and increasing the amount of electricity available for export.

During startup, a plant must use a battery, emergency generator (mobile or stationary), or other selected source to provide electricity to run the IHP compressors and pumps. Once the plant is operating in a steady state, the external power source may be removed or shut down until there is a future need for another start-up. Appropriate electric output, critical temperatures, and flows may be monitored. Oversight may be on-site or remote. After steady state operation is achieved, the plant continues to run with little human intervention except for periodic preventive maintenance and remote monitoring. Accordingly, other than energy needed during the initial start-up sequence, no fuel is consumed, no carbon is emitted, and the system does not include a cooling tower or cooling tower plume.

A stack of multiple IHPs connected in series, each one raising the temperature of a stream of heating hot water or heat transfer fluid leaving the previous IHP by a designated fraction of the total required heat load, supplies the heat required to vaporize a pressurized liquid ORC refrigerant in the evaporator of a coupled ORC. A source water pump is installed to draw source water from the source water reservoir or manifold and supply it to each of the IHPs in the stack.

An ORC is mounted adjacent to the IHPs. The ORC refrigerant condenser is mounted near the outlet of the ORC turboexpander.

The vaporized ORC refrigerant from the ORC evaporator is fed to the ORC turboexpander which generates electricity. The spent ORC refrigerant vapor leaving the turboexpander must be condensed, collected in a receiver tank, and then pressurized by a feed pump to return to its original high pressure in the evaporator. The suction side of the feed pump draws the condensed ORC refrigerant from the discharge port of the receiver tank and pressurizes it to drive it from the feed pump discharge port through a heat exchanger preheater that preheats the cold pressurized liquid ORC refrigerant using a side stream of the available source water as a heat source. The preheater heat exchanger passively raises the temperature of the liquid ORC refrigerant, thereby reducing the thermal output required from the IHPs. This reduces the electric input required by the IHPs and therefore increases the amount of electricity available for export. The preheated ORC refrigerant then enters the ORC evaporator where it is vaporized by the thermal output of the IHP stack. A line with a cooling water pump transports cooling condenser water from an external source to the ORC condenser. Another line returns the warmed cooling water leaving the ORC condenser to the source at a point downstream from the intake point.

The hot IHP refrigerant vapor leaving the compressor in each industrial IHP is fed to the industrial IHP condenser.

A second pipe may transport the leaving source water from each IHP evaporator back to the source water reservoir. The stack may have a combined return pipe or each IHP may have an individual return pipe.

Some of the source water being pumped to the industrial IHP evaporators is diverted to the ORC condensate preheater to preheat the ORC refrigerant condensate before it is transported to the evaporator of the ORC to be vaporized.

The incoming preheated and pressurized ORC refrigerant is vaporized by the stream of heating hot water or heat transfer fluid produced by the industrial IHPs.

The industrial IHP extracts heat from the source water to vaporize the industrial IHP refrigerant in its evaporator, compresses the vapor to raise its temperature, and then delivers the hot refrigerant vapor to its condenser.

The hot pressurized refrigerant vapor leaving the compressor flows to one chamber or tube of the IHP condenser where it transfers its latent heat to a stream of heating hot water or heat transfer fluid passing through the second chamber or tube of the condenser and raising the temperature of the heat transfer fluid. This process condenses the IHP refrigerant which then passes through an expansion valve and returns to the inlet port of the IHP evaporator.

In some embodiments, a sum of a temperature increase imparted to the sink heat transfer fluid by each of the multiple IHPs is a temperature rise determined for a specified external thermal load and does not exceed a maximum total temperature rise of 150° F.

In some embodiments, the ORC refrigerant has a saturated vapor temperature at a first pressure that is less than 100° F. higher than an inlet temperature of the source water.

Figure 2:
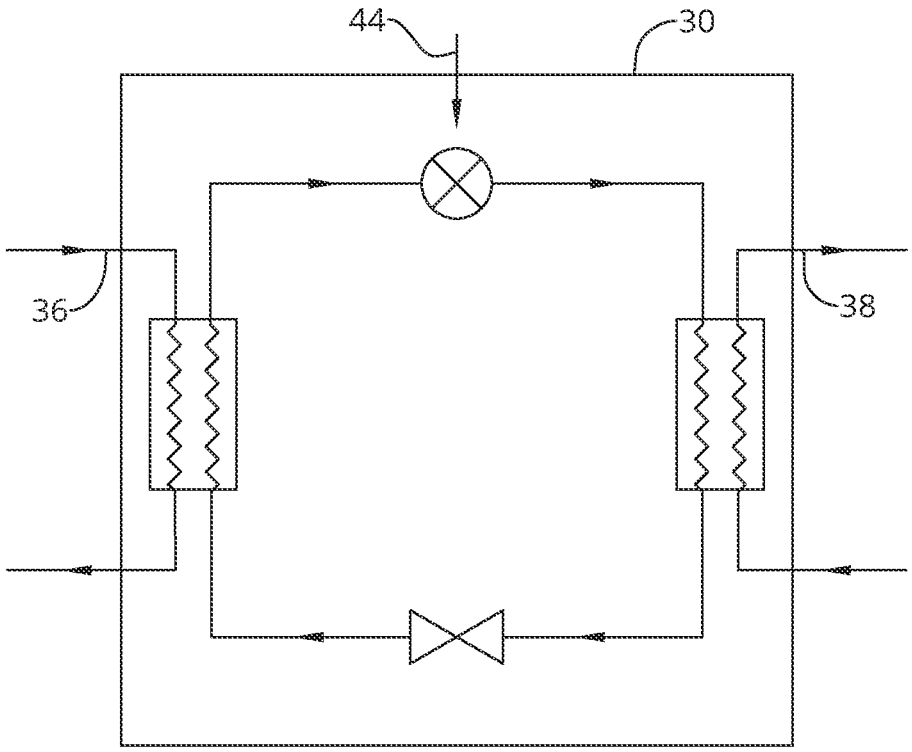
FIG. 2 is a schematic view of an IHP component of the system of FIG. 1.

Referring to FIGS. 1 and 2, FIG. 1 illustrates a non-limiting example of the electrical power generation plant according to an embodiment of the present invention. The system generally has a closed loop of heat transfer fluid, such as water, a closed loop of ORC refrigerant or working fluid; a warm water circulation that draws from a first water source and discharges downstream thereof; and a cool water circulation that draws from a second water source and discharges downstream thereof.

A series of n industrial multi-stage IHPs 30 receives a flow of source water via a water pump 34 and source water lines 36 from the body of water that serves as a first water source 32. The IHPs 30 extract heat from the stream of source water. Each IHP 30 contains a compressor (see FIG. 2). The IHPs 30 raise the temperature of a closed loop stream of heat transfer fluid 38, such as water referred to sometimes herein as heating hot water, that is circulated by pump 40 from each IHP 30 to the next one (1 . . . n−1 . . . n). Each IHP 30 raises the temperature of the heating hot water 38 by a prescribed fraction of the total required heating load. The heating hot water 38 leaving the last IHP n in the stack provides the heat required to vaporize a pressurized liquid ORC refrigerant 14 in an evaporator 28 of an adjacent organic Rankine cycle (ORC) generator 10.

The ORC generator 10 generates electrical power, which may be delivered internally to power the system via distribution lines 44 and exported to the end user via an interface to an electric grid 46. The ORC generator 10 contains an ORC turboexpander 12, which receives ORC working fluid or refrigerant 14 from the ORC evaporator 28 to generate electricity. An ORC refrigerant condenser 18 is a counter flow heat exchanger which receives the spent refrigerant vapor 14 from the turboexpander 12 and condenses it to a liquid state. The condenser 18 receives a flow of cool water from a second external source 16 that serves as condenser water, obtained with an ORC condenser water pump 20 and discharges the condenser water back to the second external source body of water 16. The liquid refrigerant 14 is delivered to an ORC condensate receiver tank 22 prior to being drawn into the liquid refrigerant feed circuit, which includes an ORC condensate feed pump 24 and an ORC condensate preheater 26.

A stream of diverted source water 36 for the preheater/heat exchanger 26 in the ORC refrigerant circuit is piped back to the source water reservoir 32 at a point downstream from the intake point because the source water has been cooled by preheating the cool liquid ORC refrigerant 14.

FIG. 2 illustrates a non-limiting example of an IHP 30 of FIG. 1. The source water 36 enters an evaporator, which transfers heat from the source water 36 to a refrigerant, which is vaporized. A compressor drawing electricity 44 compresses the refrigerant vapor, thereby increasing its temperature and pressure. The refrigerant vapor is condensed to a liquid phase in a condenser that transfers the heat to the heat transfer fluid 38. The source water 36 is discharged and the heat transfer fluid 38 is transported to a subsequent IHP 30 or the evaporator 28. The inventive system may further include flow and temperature sensors, electricity monitoring devices, and a battery or other power source for start-up, not shown.

Figure 3:
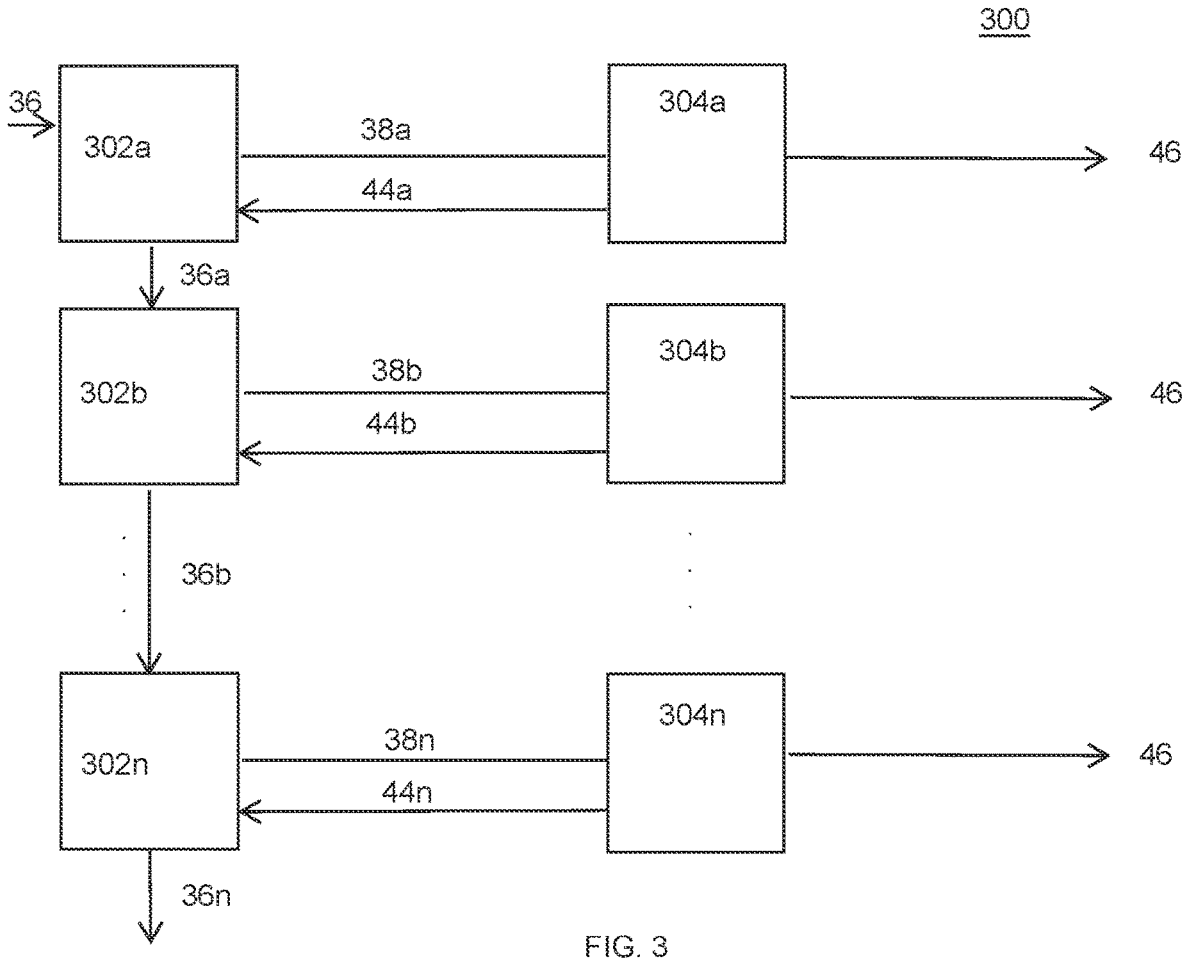
FIG. 3 is a schematic view of a system according to another embodiment of the present invention.

FIG. 3 illustrates a non-limiting example of a system 300 with multiple IHP stacks 302*a*, 302*b* . . . 302*n*, connected to multiple ORCs 304*a*, 304*b* . . . 304*n*. In this embodiment, system 300 includes a second stack 302*a* coupled to a second organic Rankine cycle generator 304*a* and configured to receive the source water discharged 36 from the multiple IHPs 30 of FIG. 1. Heat is transferred from the IHP stack 302*a* to the ORC generator 304*a* via heat transfer fluid 38*a* and power is returned to the IHP stack 302*a* from the ORC generator 304*a* via line 44*a*. Additional stacks 302*b* . . . 302*n* receive the source water discharged from the previous stack. The additional stacks 302*b* . . . 302*n* are coupled to additional organic Rankine cycle generators 304*b* . . . 304*n* in the manner described above. Spent source water 36*n* is discharged to a water body, such as the source water reservoir 32 (see FIG. 1).

It should be understood, of course, that the foregoing relates to exemplary embodiments of the invention and that modifications may be made without departing from the spirit and scope of the invention as set forth in the following claims.

What is claimed is:

1. A coupled industrial heat pump (IHP)/organic Rankine cycle (ORC) power generation system comprising:

(a) a stack of multiple IHPs connected in series, the stack configured to maximize its net coefficient of performance, defined as a total thermal energy output of the stack divided by a total electric energy input to the stack, each of the multiple IHPs including:

a first evaporator operative to transfer heat from a stream of a source water to a first refrigerant, thereby vaporizing the first refrigerant isothermally from a liquid state to a vapor state at a specified first evaporator pressure, while reducing the source water from an inlet temperature from-to an outlet temperature;

a compressor coupled to the first evaporator and operative to receive the first refrigerant in its vapor state from the first evaporator and compress it to a compressor pressure at a compressor temperature;

a first condenser coupled to the compressor and operative to receive the first refrigerant leaving the compressor in a compressed condition in its vapor state and to transfer the heat from the first refrigerant to a sink heat transfer fluid, thereby raising the sink heat transfer fluid from a first sink temperature to a second sink temperature and causing the first refrigerant to condense to its liquid state; and an expansion valve fluidly communicating with the first condenser and with the first evaporator, wherein the expansion valve is operative to accommodate the first refrigerant in its liquid state as it is passed at constant enthalpy to the first evaporator at the first evaporator pressure and a first evaporator temperature;

wherein a sum of a temperature increase imparted to the sink heat transfer fluid by each of the multiple IHPs is a temperature rise determined for a specified external thermal load and does not exceed a maximum total temperature rise of 150° F., thereby limiting thermal loads of each of the multiple IHPs;

wherein each of the multiple IHPs is connected to a reservoir or a manifold having an incoming flow of the source water, modulating the incoming flow to each of the multiple IHPs to maintain a specified temperature drop of the source water as it passes through the first evaporator, wherein the temperature rise in each of the multiple IHPs is disproportionately allocated such that, relative to that of other of the multiple IHPs, if the second sink temperature is low, a lift is small, and a COP is high, a temperature increase allocated to the IHP is high and if the second sink temperature is high, the lift is large, and the COP is low, the temperature increase allocated to the IHP is low; and (b) an organic Rankine cycle generator coupled to the multiple IHPs, the organic Rankine cycle generator having:

a second evaporator configured to receive the sink heat transfer fluid at a sink outlet temperature from the stack and operative to transfer the heat from the sink heat transfer fluid to a second refrigerant, vaporizing the second refrigerant from its liquid state to its vapor state;

a turboexpander configured to receive the second refrigerant from the second evaporator and operative to generate electricity;

a second condenser configured to receive the second refrigerant leaving the turboexpander and operative to condense the second refrigerant from its vapor state to its liquid state;

a condensate receiving tank coupled to the second condenser and operative to collect the second refrigerant in its liquid state; and a feed pump coupled to the condensate receiving tank, operative to extract, pressurize, and deliver the second refrigerant to the second evaporator at a second evaporator pressure;

wherein the stack and the second evaporator of the ORC are configured to circulate the sink heat transfer fluid in a closed loop, sequentially through each of the multiple IHPs and through the second evaporator.

2. The power generation system of claim 1, further comprising a preheater heat exchanger having an inlet and an outlet operative to accommodate a portion of the source water, the preheater heat exchanger fluidly communicating with the feed pump and the second evaporator; wherein the preheater heat exchanger is operative to transfer the heat from the source water to the second refrigerant; and wherein the feed pump is operative to convey the second refrigerant to the preheater heat exchanger and to the second evaporator at the second evaporator pressure.

3. The power generation system of claim 1, wherein the multiple IHPs are arranged in series and each of the multiple IHPs is configured to raise the second sink temperature of a preceding one of the multiple IHPs by a predetermined fraction of a total heating load.

4. The power generation system of claim 1, wherein the reservoir or the manifold fluidly communicates with each of the multiple IHPs in the stack and is operative to feed the source water to the multiple IHPs in parallel.

5. The power generation system of claim 1, further comprising a discharge line fluidly communicating with each of the multiple IHPs and operative to discharge the source water downstream from its intake.

6. The power generation system of claim 1, wherein the second condenser is configured to accommodate counter-current flows of the second refrigerant and a cooling water and is operative to condense the second refrigerant by transferring the heat from the second refrigerant to the cooling water.

7. The power generation system of claim 1, further comprising a second stack coupled to a second organic Rankine cycle generator and configured to receive the source water discharged from the multiple IHPs and further comprising additional stacks coupled to additional organic Rankine cycle generators, each configured to receive the source water discharged from the multiple IHPs of the previous stack.

8. A coupled industrial heat pump (IHP)/organic Rankine cycle (ORC) power generation system comprising:

(a) a stack of multiple IHPs connected in series, the stack configured to maximize its net coefficient of performance, defined as a total thermal energy output of the stack divided by a total electric energy input to the stack, each of the multiple IHPs including:

a first evaporator operative to transfer heat from a stream of a source water to a first refrigerant, thereby vaporizing the first refrigerant isothermally from a liquid state to a vapor state at a specified first evaporator pressure, while reducing the source water from an inlet temperature to an outlet temperature;

a compressor coupled to the first evaporator and operative to receive the first refrigerant in its vapor state from the first evaporator and compress it to a compressor pressure at a compressor temperature;

a first condenser coupled to the compressor and operative to receive the first refrigerant leaving the compressor in a compressed condition in its vapor state and to transfer the heat from the first refrigerant to a sink heat transfer fluid, thereby raising the sink heat transfer fluid from a first sink temperature to a second sink temperature and causing the first refrigerant to condense to its liquid state; and a flashing liquid expander containing a first turboexpander, the flashing liquid expander fluidly communicating with the first condenser and with the first evaporator, wherein the flashing liquid expander is operative to accommodate the first refrigerant in its liquid state as it is passed at constant enthalpy to the first evaporator at the first evaporator pressure and a first evaporator temperature;

wherein a sum of a temperature increase imparted to the sink heat transfer fluid by each of the multiple IHPs is a temperature rise determined for a specified external thermal load and does not exceed a maximum total temperature rise of 150° F., thereby limiting thermal loads of each of the multiple IHPs;

wherein each of the multiple IHPs is connected to a reservoir or a manifold having an incoming flow of the source water, modulating the incoming flow to each of the multiple IHPs to maintain a specified temperature drop of the source water as it passes through the first evaporator, wherein the temperature rise in each of the multiple IHPs is disproportionately allocated such that, relative to that of other of the multiple IHPs, if the second sink temperature is low, a lift is small, and a COP is high, a temperature increase allocated to the IHP is high and if the second sink temperature is high, the lift is large, and the COP is low, the temperature increase allocated to the IHP is low; and (b) an organic Rankine cycle generator coupled to the multiple IHPs, the organic Rankine cycle generator having:

a second evaporator configured to receive the sink heat transfer fluid at a sink outlet temperature from the stack and operative to transfer the heat from the sink heat transfer fluid to a second refrigerant, vaporizing the second refrigerant from its liquid state to its vapor state;

a second turboexpander configured to receive the second refrigerant from the second evaporator and operative to generate electricity;

a second condenser configured to receive the second refrigerant leaving the second turboexpander and operative to condense the second refrigerant from its vapor state to its liquid state;

a condensate receiving tank coupled to the second condenser and operative to collect the second refrigerant in its liquid state; and a feed pump coupled to the condensate receiving tank, operative to extract, pressurize, and deliver the second refrigerant to the second evaporator at a second evaporator pressure;

wherein the stack and the second evaporator of the ORC are configured to circulate the sink heat transfer fluid in a closed loop, sequentially through each of the multiple IHPs and through the second evaporator the flashing liquid expander utilizes a difference between a first condenser pressure and the first evaporator pressure to drive the first turboexpander, thereby generating additional electricity and reducing an electricity draw from an electric output of the ORC.

9. A method of power generation, comprising:

providing a plurality of industrial heat pumps (IHPs) and an organic Rankine cycle generator (ORC) having an ORC evaporator and an ORC turboexpander;

circulating a sink heat transfer fluid through each of the plurality of IHPs in series and through the ORC evaporator;

feeding a source water to each of the plurality of IHPs;

transferring heat from the source water to the sink heat transfer fluid in each of the plurality of IHPs;

circulating an ORC refrigerant through the ORC evaporator and the ORC turboexpander;

transferring the heat from the sink heat transfer fluid to the ORC refrigerant via the ORC evaporator;

returning the sink heat transfer fluid to the plurality of IHPs;

generating electricity by passing the ORC refrigerant through the ORC turboexpander;

routing a first portion of the electricity to the plurality of IHPs; and exporting a second portion of the electricity.

10. The method of claim 9, further comprising:

providing a second stack with a second ORC;

feeding the source water from the plurality of IHPs to the second stack;

transferring the heat from the source water to the sink heat transfer fluid in the second stack;

transferring the heat from the sink heat transfer fluid to the ORC refrigerant in the second ORC; and generating more electricity from the ORC refrigerant in the second ORC.

11. The method of claim 9, wherein the source water has an inlet temperature of 70° F. or higher.

12. The method of claim 9, further comprising obtaining the source water from a chiller, a power plant, or an industrial facility, and discharging the cooled source water, after passing through multiple IHPs, at a cooling tower target temperature to the chiller, the power plant, or the industrial facility without using a cooling tower.

13. The method of claim 9, further comprising transferring heat from the ORC refrigerant to a condensing water, wherein an initial temperature of the condensing water is more than 20° F. lower than an inlet temperature of the source water.

14. The method of claim 9, wherein the source water is fed at a flowrate corresponding to a predetermined temperature drop across each of the plurality of IHPs.

15. The method of claim 9, further comprising configuring the plurality of IHPs to minimize the total portion of the electricity used by the plurality of IHPs by disproportionately allocating to each of the plurality of IHPs a percentage of a total temperature increase of the sink heat transfer fluid that is directly correlated with its coefficient of performance and inversely related to its lift, an outlet temperature of the sink heat transfer fluid, and a temperature difference between the outlet temperature and an inlet temperature of the source water, relative to a remainder of the plurality of IHPs.

16. The method of claim 9, wherein the ORC refrigerant has a saturated vapor temperature at a first pressure that is less than 100° F. higher than an inlet temperature of the source water.

17. The method of claim 9, further comprising raising the sink heat transfer fluid collectively to a temperature operative at a selected flowrate to vaporize the ORC refrigerant.

18. The method of claim 9, wherein a cumulative thermal output of the plurality of IHPs is operative to vaporize the ORC refrigerant.

19. The method of claim 9, wherein the ORC refrigerant has a selected evaporation temperature at a second evaporator pressure and a selected flow rate.

20. The method of claim 9, further comprising determining a total temperature rise of the sink heat transfer fluid and allocating a percentage of the total temperature rise to each of the plurality of IHPs.

* * * * *